US007008916B2

(12) United States Patent
Carswell et al.

(10) Patent No.: US 7,008,916 B2
(45) Date of Patent: Mar. 7, 2006

(54) FABRIC CARE COMPOSITION

(75) Inventors: Robert John Carswell, Merseyside (GB); James Bernard Cooper, Merseyside (GB)

(73) Assignee: Unilever Home & Personal Care USA, Greenwich, CT (US)

( * ) Notice: Subject to any disclaimer, the term of this patent is extended or adjusted under 35 U.S.C. 154(b) by 191 days.

(21) Appl. No.: 10/404,611

(22) Filed: Mar. 28, 2003

(65) Prior Publication Data

US 2003/0191044 A1 Oct. 9, 2003

(30) Foreign Application Priority Data

Apr. 3, 2002 (GB) ..... 0207744

(51) Int. Cl.

| | |
|---|---|
| ***C11D 3/37*** | (2006.01) |
| ***C11D 3/06*** | (2006.01) |
| ***C11D 3/20*** | (2006.01) |
| ***D06M 15/19*** | (2006.01) |

(52) U.S. Cl. ..... 510/475; 510/361; 510/434; 510/533; 8/115.6; 8/115.56

(58) Field of Classification Search ..... 510/361, 510/434, 475, 533; 8/115.6, 115.56
See application file for complete search history.

(56) References Cited

U.S. PATENT DOCUMENTS

| | | | | |
|---|---|---|---|---|
| 4,820,307 | A | | 4/1989 | Welch et al. |
| 4,975,209 | A | | 12/1990 | Welch et al. |
| 5,205,836 | A | | 4/1993 | Hansen et al. |
| 5,221,285 | A | | 6/1993 | Andrews et al. |
| 5,496,476 | A | * | 3/1996 | Tang et al. ..... 8/120 |
| 5,938,995 | A | * | 8/1999 | Koltisko et al. ..... 264/128 |
| 6,001,343 | A | | 12/1999 | Trinh et al. |
| 6,334,904 | B1 | | 1/2002 | Ahnsorge et al. |

FOREIGN PATENT DOCUMENTS

| | | |
|---|---|---|
| EP | 0 354 648 A2 | 2/1990 |
| EP | 0 688 897 A1 | 12/1995 |
| EP | 0 778 339 A2 | 6/1997 |
| JP | 04 040234 | 2/1992 |
| JP | 04 0050234 | 2/1992 |
| WO | 96/15309 | 5/1996 |
| WO | 96/15310 | 5/1996 |
| WO | 98/04772 | 2/1998 |
| WO | 99/55951 | 11/1999 |
| WO | 01/44426 | 6/2001 |
| WO | 01/61100 | 8/2001 |

OTHER PUBLICATIONS

*International Search Report PCT/EP 03/03321 dated Jun. 30, 2003-4 pp.*
UK Search Report GB 0207744.4 dated Jan. 15, 2003 —1 p. WPI Derwent Acct. No. 1992-109202/199214 abstract of JP 04 050234 —1 p.
Rawls et al. *The Relationship Between Polymer Elastic Properties and the Ability to Impart Improved Wrinkle Recovery to Cotton Fabric, Journal of Applied Polymer Science* vol. 15, pp. 341-349 (1971).
U.S. Appl. No. 10/401,454, filed Mar. 28, 2003, Carswell et al., Fabric Care Composition.

* cited by examiner

*Primary Examiner*—Brian P. Mruk
(74) *Attorney, Agent, or Firm*—Alan A. Bornstein

(57) ABSTRACT

This invention relates to a fabric care composition comprising a polycarboxylic acid or a derivative thereof, a catalyst and a thermoplastic elastomer, a method of treating fabric with such a composition and the use of such a composition to increase the tensile strength (especially the tear strength) of a fabric, to reduce creasing and/or wrinkling of a fabric and/or to improve the elasticity and/or shape retention of a fabric.

23 Claims, No Drawings

FABRIC CARE COMPOSITION

TECHNICAL FIELD

This invention relates to a fabric care composition comprising a polycarboxylic acid or a derivative thereof, a catalyst and a thermoplastic elastomer, a method of treating fabric with such a composition and the use of such a composition to increase the tensile strength (especially the tear strength) of a fabric, to reduce creasing and/or wrinkling of a fabric and/or to improve the elasticity and/or shape retention of a fabric.

BACKGROUND OF THE INVENTION

The laundry process generally has several benefits for fabric, the most common being to remove dirt and stains from the fabric during the wash cycle and to soften the fabric during the rinse cycle. However, there are numerous disadvantages associated with repeated use of conventional laundry treatment compositions and/or the actual laundry process; one of these being a fairly harsh treatment of fabric in the laundry process causing fabric to lose its shape.

One aspect of the present invention is therefore directed towards maintaining the new appearance of fabric, that is to give better return (after being stretched) to the articles original shape (shape retention).

The creasing of fabrics is also an almost inevitable consequence of cleaning fabrics, such as in a domestic laundering process. Fabrics also become creased in wear. Creasing can be a particular problem for fabrics, which contain cellulosic fibres such as cotton, because the creasing is often difficult to remove. Generally, the creases, which are developed in a fabric during laundering, are removed by ironing. However, because ironing is seen as a time consuming chore, there is an increasing trend for fabrics to be designed such that the need for ironing is reduced and/or the effort required for ironing is lower.

Compositions for reducing the wrinkling of fabric are described in WO 96/15309 and WO 96/15310. The compositions contain a silicone and a film-forming polymer and it appears that it is the lubricating effect of the silicone, which is responsible for their anti-wrinkle properties. This conclusion is supported by the fact that a wide variety of polymers is mentioned as being suitable for use in the compositions.

Industrial treatments of fabrics to reduce their tendency to crease are known. JP-A-04-50234 describes a textile treatment in which the crease resistance of a plain weave cotton fabric is increased by applying a so-called "shape memory resin" to the fabric. However, this document teaches that the resin is applied to the fabric at a relatively high amount of 10% by weight on weight of fabric and it is not clear how this level of resin affects other properties of the fabric. Furthermore, treatment of the fabric with the resins is followed by a step of drying at 80° C. and the shape memory function is described as being heat-sensitive, with deformations at normal temperatures being restored to the original shape on heating at a specific temperature.

A relationship between polymer elastic properties and the ability to impart improved wrinkle recovery to cotton fabric is described by Rawls et al in *Journal of Applied Polymer Science*, vol. 15, pages 341–349 (1971). A variety of different elastomers was applied to fabric and, particularly in the few cases where thermoplastic elastomers were used, the polymers were applied to the fabric at the relatively high levels of 4% and above. There is no indication that any benefit would be obtained in applying polymers to the fabric at lower levels and no suggestion as to practical applications of the technique.

Durable press treatments (a.k.a. "permanent" press treatments) in the textile industry are well known. In the 1960's, it was known to use polycarboxylic acids for permanent press treatment of textiles. Generally, cellulose fibre can be cross-linked and esterified with polycarboxylic acids, particularly those with two or more carboxylic acid groups. Esterification is achieved upon heating the treated cellulose fibres such as by ironing or other forms of heat pressing. Curing catalysts, such as phosphorous containing salts, are also known to serve to aid cross-linking. Examples of US patents relating to durable press finishing of cotton textile with polycarboxylic acids include: U.S. Pat. No. 4,820,307 (Welch et al.), U.S. Pat. No. 4,795,209 (Welch et al.) and U.S. Pat. No. 5,221,285 (Andrews et al,). The contents of these patents are incorporated by reference. Compounds such as formaldehyde-based polymers, DMDHEU (dimethylol dihydroxy ethylene urea) and BTCA (1,2,3,4-butane tetracarboxylic acid) may be used as the cross-linking agent. However, these treatments have the disadvantage of reducing the tensile strength of the fabrics. Also, the high cure temperatures and long cure times required for such treatment have effectively prevented the use of such treatments in a domestic laundry environment.

It has now been discovered that the cure temperature and time of such processing can be reduced down to that of a domestic ironing step by using a higher level of curing catalyst in the treatment composition. Also, by incorporating a thermoplastic elastomer into the composition, the disadvantage of reducing the tensile strength of the fabric is overcome and the elasticity and resistance to creasing/wrinkling of the fabric is surprisingly improved.

The present invention therefore aims to reduce the tendency for fabrics to become wrinkled or creased.

The invention further aims to reduce the deleterious effects on elasticity and tensile strength of fabrics, which some conventional anti-wrinkle treatments impart. The invention may also provide a degree of shape retention in the fabric.

In addition, the invention aims to provide a fabric treatment which can be utilised in an industrial or domestic environment.

SUMMARY OF THE INVENTION

In a first aspect, the present invention provides a fabric care composition comprising a polycarboxylic acid or a derivative thereof, a catalyst and a thermoplastic elastomer.

In a second aspect, the invention provides a method of treating fabric which comprises treating the fabric with a fabric care composition as defined above and curing the composition.

In a third aspect, the invention provides the use of a composition as defined above to increase the tensile strength (especially the tear strength) of a fabric.

In a fourth aspect, the invention provides the use of a composition as defined above to reduce creasing and/or wrinkling of a fabric.

In a fifth aspect, the invention provides the use of a composition as defined above to improve the elasticity and/or shape retention of a fabric.

DETAILED DESCRIPTION OF THE INVENTION

The present invention involves the development of a composition for fabric care applications which is suitable for use in an industrial or domestic environment. The compositions comprise a polycarboxylic acid or a derivative thereof, a catalyst and a thermoplastic elastomer.

Polycarboxylic Acids

The polycarboxylic acids effective as cellulose crosslinking agents in this invention include aliphatic, alicyclic and aromatic acids either olefinincally saturated or unsaturated with at least three and preferably more carboxyl groups per molecule or with two carboxyl groups per molecule if a carbon-carbon double bond is present alpha, beta to one or both carboxyl groups. It is desirable that, to be reactive in esterifying cellulose hydroxyl groups, a given carboxyl group in an aliphatic or alicyclic polycarboxylic acid is separated from a second carboxyl group by no less than 2 carbon atoms and no more than three carbon atoms. In an aromatic acid, a carboxyl group is preferably ortho to a second carboxyl group if the first carboxyl is to be effective in esterifying cellulosic hydroxyl groups. It is thought that for a carboxyl group to be reactive, it must be able to form a cyclic 5- or 6-membered anhydride ring with a neighbouring carboxyl group in the polycarboxylic acid molecule. Where two carboxyl groups are separated by a carbon-carbon double bond or are both connected to the same ring, the two carboxyl groups are preferably in the cis configuration relative to each other if they are to interact in this manner.

The aliphatic or alicyclic polycarboxylic acid may also contain an oxygen or sulphur atom in the chain or ring to which the carboxyl groups are attached.

In aliphatic acids containing three or more carboxyl groups per molecule, the acid may contain a hydroxyl group attached to a carbon atom alpha to a carboxyl group.

In the context of the present invention it is preferred that the polycarboxylic acid or derivative contains at least 3 carboxyl groups, preferably between 4 and 8 carboxyl groups. It is especially preferred if at least 3 carboxyl groups, and more preferably 4 or more carboxyl groups, of the polycarboxylic acid or derivatives thereof are situated on adjacent carbon atoms. Also within the polycarboxylic acid or derivatives of the present invention are oligomers comprising monomers of the aforementioned polycarboxylic acids or derivatives thereof.

The oligomers may contain saturated or unsaturated monomers. Examples of the oligomeric polycarboxylic acids include polymaleic acid, cyclic polyacids containing varying degrees of unsaturation. Unsaturated linear oligomeric polycarboxylic acids may also be used.

The polycarboxylic acid derivatives of the invention may have 1 to 4 of the carboxyl groups esterified with a short chain ($C_{1-4}$, more preferably $C_{1-2}$) alcohol or form a salt with a suitable counterion, for example alkali metal, alkaline earth metal, ammonium compound. In addition, the polycarboxylic acid or its derivative may contain a long chain ($C_{8-22}$, preferably $C_{12-18}$) alkyl, alkenyl or acyl group.

The preferred polycarboxylic acids have the formula:

$$X—[CO_2R]_n$$

in which n is equal to 4 or more, X is a hydrocarbon backbone optionally substituted with functionalities including $C_{1-6}$ alk(en)yl, hydroxy, and acyloxy derivatives, R is independently selected from a $C_{1-4}$ alkyl chain or a $C_{2-4}$ alkenyl chain, or salt but is preferably H.

Examples of specific polycarboxylic acids which fall within the scope of the invention are the following: maleic acid, citraconic acid also called methylmaleic acid, citric acid also known as 2-hydroxy-1,2,3-propanetricarboxylic acid, itaconic acid also called methylenesuccinic acid; tricarballylic acid also known as 1,2,3-propanetricarboxylic acid; trans-aconitic acid also known as trans-1-propene-1,2,3-tricarboxylic acid; 1,2,3,4-butanetetracarboxylic acid; all-cis-1,2,3,4-cyclopentanetetracarboxylic acid; mellitic acid also known as benzenehexacarboxylic acid; oxydisuccinic acid also known as 2,2'-oxybis(butanedioic acid); thiodisuccinic acid; and the like.

Preferred polycarboxylic acids include 1,2,3,4-cyclopentanetetracarboxylic acid, 1,2,3,4-butanetetracarboxylic acid (BTCA) and citric acid, with the latter two compounds being especially preferred.

Catalysts

Without being bound by theory it is thought that polycarboxy groups reduce creasing of the fabric in that crosslinking occurs via ester bonding. It is advantageous if a catalyst is used with compositions of the invention to aid the formation of the ester links. Preferred catalysts are 1,2,4-triazole, 1H-1,2,3-triazole, 1H-tetrazole, 3-methyl pyrazole, 3-methyl pyridazine, 1H-purine, 2,3-pyrazine dicarboxylic acid, 2-dimethylamino pyridine, picolinic acid, 6-methyl-3,3-pyridine dicarboxylic acid, imidazole, 1-methylimidazole, 2-methylimidazole, 4-methylimidazole, 2-ethylimidazole, 1-vinylimidazole, 1,2-dimethylimidazole, 2-ethyl-4-methylimidazole. Other catalysts include salts of organic acids such as mono-, di- and tri-sodium citrate, mono- and di-sodium maleate, mono- and di-sodium fumarate, and similar salts of succinic and tartaric acids.

Inorganic catalysts may also be used, especially phosphorus-containing salts.

The most active and effective curing catalysts of this invention are alkali metal hypophosphites, which in anhydrous form have the formula $MH_2PO_2$, where M is an alkali metal atom.

A second class of curing catalysts employed in the present invention are alkali metal phosphites having the formula $MH_2PO_3$ and $M_2HPO_3$. These are nearly as active as alkali metal hypophosphites.

A third class of curing catalysts employed in the process of the present invention are the alkali metal salts of polyphosphoric acids. These are condensed phosphoric acids and encompass the cyclic oligomers trimetaphosphoric acid and tetrametaphosphoric acid, and acyclic polyphosphoric acids containing 2 to 50 phosphorus atoms per molecule including pyrophosphoric acid. Specific examples of effective catalysts in this class are disodium acid pyrophosphate, tetrasodium pyrophosphate, pentasodium tripolyphosphate, the acyclic polymer known as sodium hexametaphosphate, and the cyclic oligomers sodium trimetaphosphate and sodium tetrametaphosphate.

A fourth class of curing catalysts suitable in special cases in the process of the present invention are the alkali metal dihydrogen phosphates such as lithium dihydrogen phosphate, sodium dihydrogen phosphate and potassium dihydrogen phosphate.

It is especially preferred that the catalyst is sodium hypophosphite ($Na_2H_2PO_2$), When the polycarboxylic acid is BTCA or citric acid, the preferred catalyst is $NaH_2PO_2$.

Thermoplastic Elastomers

The thermoplastic elastomer is preferably a block copolymer comprising a core polymer and two or more flanking polymers, each flanking polymer being covalently bound to an end of the core polymer. Preferably, the backbone of the core polymer comprises at least a proportion of C—C (i.e. carbon-carbon) bonds and/or Si—O (ie. silicon-oxygen) bonds and two or more flanking polymers. The linkages in the backbone of the core polymer preferably comprise greater than 30%, more preferably greater than 50%, even more preferably greater than 75%, most preferably greater than 95%, such as, for example, at least 99% (these percentages being by number) C—C and/or Si—O bonds. In some cases, the backbone may contain 100% (by number) C—C and/or Si—O bonds.

Other bonds which may be present in the backbone of the core polymer, in addition to the C—C and/or Si—O bonds, include, for example, C—O bonds. The flanking polymers are bound to an end of the core polymer. Preferably, the flanking polymers comprise at least a proportion of C—C (ie, carbon-carbon) bonds. The linkages in the backbone of the flanking polymer preferably comprise greater than 50%, more preferably greater than 75%, most preferably greater then 95%, such as, for example, at least 99% (these percentages being by number) C—C bonds. In some cases, the backbone of the flanking polymer may contain 100% (by number) C—C bonds. Other bonds which may be present in the backbone of the flanking polymer, in addition to the C—C bonds, include, for example, C—O and C—N bonds.

The core polymer can take a number of different forms. For example, the core polymer may be linear, branched, radial or star-shaped (the latter polymers also being termed "aerial"). Star-shaped polymers may have three or more arms. When the core polymer is linear, a flanking polymer is bound to each end of the core polymer and the resulting block copolymer is an ABA block copolymer; this is a preferred embodiment of the present invention. When the core polymer is star-shaped, a flanking polymer is bound to each end of the core polymer and the block copolymer therefore contains as many flanking polymers as there are points or free ends in the star shaped polymer. For example, if the star shaped core polymer has four ends the block copolymer will comprise four flanking polymer groups.

The block copolymer may therefore have the structure $(AB)_n$-Core, where A and B are polymeric blocks, n is 2 or more (preferably 2, or 4, 6, 8 or 12) and Core is a non-polymeric linking core. For ABA block copolymers, there may or may not be a non-polymeric core in the B block, depending on how polymerisation is carried out. In one preferred embodiment of the invention, the A and B blocks are each derived from a single monomer.

Usually, the flanking polymer (such as component A in an ABA block polymer) comprises or consists of a material that is hard at room temperature (ie, it has a high Tg) but becomes soft and fluid upon heating. Such materials are known in the art as "hard" blocks. The core polymer (such as component B in an ABA block copolymer) comprises or consists of a material that is soft at room temperature (ie, it has a low Tg). Materials of this latter type are known in the art as "soft blocks".

The glass transition temperature (Tg) of the flanking polymer (eg, in the case of an ABA block copolymer, the A blocks) is typically from 0 to 300° C., preferably from 25 to 175° C., more preferably from 30 to 150° C. The glass transition temperature of the core polymer (eg, in the case of an ABA block copolymer, the B blocks) is typically from −200 to 150° C., preferably from −150 to 75° C., more preferably from −150 to 50° C. (such as from −150 to less than 30°C.). Those skilled in the art will appreciate that the particular Tg values in any given case will depend on the overall nature of the polymer and the identity of the particular core and flanking polymers. The main requirement is that the flanking polymers will constitute hard blocks, whilst the core polymer will be a soft block. Typically, this means that the Tg of the flanking polymers will be higher than that of the core polymer.

Tg or glass transition is a well-known term in polymer science that is used to describe the temperature at which a polymer or a segment thereof undergoes a transition from a solid or brittle material to a liquid or rubber-like material. The glass transition temperature can be measured by a variety of standard techniques that are well known in polymer science. A common technique for the determination of glass transition temperature is differential scanning calorimetry, commonly known as DSC. The glass transition phenomenon in polymers is described in polymer textbooks and encyclopaedias, for example "Principles of Polymer Chemistry", A Ravve, Plenum Press, New York and London 1995, ISBN 0-306-44873-4.

The core and flanking polymer segments are generally thermodynamically incompatible and they will therefore phase separate into multiphase compositions in which the phases are intimately dispersed.

The core polymer typically has a number average molecular weight of from 100 to 10,000,000 Da (preferably from 1,000 to 200,000 Da, more preferably from 1,000 to 100,000 Da) and a weight average molecular weight of from 100 to 20,000,000 Da (preferably from 1,000 to 500,000 Da, more preferably from 1,000 to 450,000 Da, even more preferably from 1,000 to 400,000 Da). The flanking polymers preferably have a number average molecular weight of from 80 to 500,000 Da (preferably from 100 to 100,000 Da) and a weight average molecular weight of from 80 to 700,000 Da (preferably from 100 to 250,000 Da, more preferably from 200 to 250,000 Da). The molar ratio of the core polymer to the flanking polymers is typically from 1:10 to 10:1.

Conveniently, the thermoplastic polymers have a molecular weight of from 1,000 to 2,000,000, preferably from 2,000 to 1,000,000 and most preferably from 3,000 to 500,000.

Preferably, the polymer consists essentially of (ie, contains at least 95% and preferably substantially 100%) atoms selected from carbon, hydrogen, silicon, oxygen and nitrogen.

Each of the flanking polymers may, independently, comprise the same or different monomers. Hence, the copolymers used in the invention include, for example, ABA and ABC block copolymers.

The flanking polymers in each thermoplastic elastomer molecule are preferably substantially identical in terms of their composition and molecular weight. However, the flanking polymers may, alternatively, be different from each other in terms of their composition and/or molecular weight.

Preferably, the flanking polymer and/or the core polymer, more preferably both the core polymer and the flanking polymer, comprise backbones which are obtainable by free radical polymerisation of vinylic monomers. Suitable vinylic monomers include those based on alkadiene, acrylate/methacrylate, acrylamide, alkene and/or styrenic systems. However, other block copolymeric systems such as those derived by, for example, addition polymerisation mechanisms such as polycondensation can also be utilised, provided that the flanking and core polymers are derived from hard and soft segments, respectively.

The block copolymers of the present invention can be produced by standard polymerisation techniques such as anionic or living free radical polymerisation methodologies. Suitable methods for preparing the polymers will be known to those skilled in the art.

Free radically polymerisable monomers suitable for use in polymerisation methods to produce polymers suitable for use in the present invention are preferably ethylenically unsaturated monomers. The living free radical polymerisation route is preferred due to its versatility and commercial viability. By "polymerisable" is preferably meant monomers that can be polymerised in accordance with a living radical polymerisation.

By "ethylenically unsaturated" is meant monomers that contain at least one polymerisable carbon-carbon double bond (which can be mono-, di-, tri- or tetra-substituted). Either a single monomer or a combination of two or more monomers can be utilised. In either case, the monomers are selected to meet the physical and chemical requirements of the final block copolymer.

Suitable ethylenically unsaturated monomers useful herein include alkenes (such as ethene, propene, butene etc.) styrenes, alkadienes (such as butadiene) and protected or non-protected acrylic acid and methacrylic acid and salts, esters, anhydrides and amides thereof.

The acrylic acid and methacrylic acid salts can be derived from any of the common non-toxic metal, ammonium, or substituted ammonium counter ions.

The acrylic acid and methacrylic acid esters can be derived from $C_{1-40}$ straight chain, $C_{3-40}$ branched chain, or $C_{3-40}$ carbocyclic alcohols, from polyhydric alcohols having from about 2 to about 8 carbon atoms and from about 2 to about 8 hydroxyl groups (non-limiting examples of which include ethylene glycol, propylene glycol, butylene glycol, hexylene glycol, glycerin, and 1,2,6-hexanetriol); from amino alcohols (non-limiting examples of which include aminoethanol, dimethylaminoethanol and diethylaminoethanol and their quaternised derivatives); or from alcohol ethers (non-limiting examples of which include methoxyethanol and ethoxyethanol).

The acrylic acid and methacrylic acid amides can be unsubstituted, N-alkyl or N-alkylamino mono-substituted, or N,N-dialkyl, or N,N-dialkylamino disubstituted, wherein the alkyl or alkylamino groups can be derived from $C_{1-40}$ (preferably $C_{1-10}$) straight chain, $C_{3-40}$ branched chain, or $C_{3-40}$ carbocyclic moieties. In addition, the alkylamino groups can be quaternised.

Also useful as monomers are protected and unprotected acrylic or/and methacrylic acids, salts, esters and amides thereof, wherein the substituents are on the two and/or three carbon position of the acrylic and/or methacrylic acids, and are independently selected from $C_{1-4}$ alkyl, hydroxyl, halide (—Cl, —Br, —F, —I), —CN, and —$CO_2H$, for example methacrylic acid, ethacrylic acid, alpha-chloroacrylic acid and 3-cyano acrylic acid. The salts, esters, and amides of these substituted acrylic and methacrylic acids can be defined as described above for the acrylic/methacrylic acid salts, esters and amides.

Other useful monomers include vinyl and allyl esters of $C_{1-4}$ straight chain, $C_{3-40}$ branched chain, or $C_{3-40}$ carbocyclic carboxylic acids, vinyl and allyl halides (eg, vinyl chloride, allyl chloride), (eg, vinyl pyridine, allyl pyridine); vinylidene chloride; and hydrocarbons having at least one unsaturated carbon-carbon double bond (eg, styrene, alpha-methylstyrene, t-butylstyrene, butadiene, isoprene, cyclohexadiene, ethene, propene, 1-butene, 2-butene, isobutene, p-methylstyrene); and mixtures thereof. Of these, ethene, propane, butene, styrene and butadiene are especially preferred.

Other preferred ethylenically unsaturated monomers have the following general formula:

$$H(R^1)C{=}C(R^2)(C(O)G)$$

in which $R^1$ and $R^2$ are independently selected from hydrogen, $C_1$–$C_{10}$ straight or branched chain alkyl (the term alkyl, when used herein, refers to straight chain and branched groups), methoxy, ethoxy, 2-hydroxyethoxy, 2-methoxyethyl and 2-ethoxyethyl groups;

G is selected from hydroxyl, —$O(M)_{1/v}$, —$OR^3$—$NH_2$, —$NHR^3$ and —$N(R^3)(R^4)$;

where M is a counter-ion of valency v selected from metal ions such as alkali metal ions and alkaline earth metal ions, ammonium ions and substituted ammonium ions such as mono-, di-, tri- and tetraalkylammonium ions, and each $R^3$ and $R^4$ is independently selected from hydrogen, $C_1$–$C_8$ straight or branched chain alkyl, glycerol, N,N-dimethylaminoethyl, 2-hydroxyethyl, 2-methoxyethyl, and 2-ethoxyethyl.

More preferred specific monomers useful herein include those selected from protected and unprotected acrylic acid, methacrylic acid, ethacrylic acid, methyl acrylate, ethyl acrylate, ∀-butyl acrylate, iso-butyl acrylate, t-butyl acrylate, 2-ethylhexyl acrylate, decyl acrylate, octyl acrylate, methyl methacrylate, ethyl methacrylate, n-butyl methacrylate, iso-butyl methacrylate, t-butyl methacrylate, 2-ethylhexyl methacrylate, decyl methacrylate, methyl ethacrylate, ethyl ethacrylate, n-butyl ethacrylate, iso-butyl ethacrylate, t-butyl ethacrylate, 2-ethylhexyl ethacrylate, decyl ethacrylate, 2,3-dihydroxypropyl acrylate, 2,3-dihydroxypropyl methacrylate, 2-hydroxyethyl acrylate, 2-hydroxpropyl acrylate, hydroxypropyl methacrylate, glyceryl monoacrylate, glyceryl monoethacrylate, glycidyl methacrylate, glycidyl acrylate, glycerol methacrylate, acrylamide, methacrylamide, ethacrylamide, N-methyl acrylamide, N,N-dimethyl acrylamide, N,N-dimethyl methacrylamide, N-ethyl acrylamide, N-isopropyl acrylamide, N-butyl acrylamide, N-t-butyl acrylamide, N,N-di-n-butyl acrylamide, N,N-diethylacrylamide, N-octyl acrylamide, N-octadecyl acrylamide, N,N-diethylacrylamide, N-phenyl acrylamide, N-methyl methacrylamide, N-ethyl methacrylamide, N-dodecyl methacrylamide, N,N-dimethylaminoethyl acrylamide, quaternised N,N-dimethylaminoethyl acrylamide, N,N-dimethylaminoethyl methacrylamide, quaternised N,N-dimethylaminoethyl methacrylamide, N,N-dimethylaminoethyl acrylate, N,N-dimethylaminoethyl methacrylate (i.e. 2-dimethylaminoethyl methacrylate) quaternised N,N-dimethyl-aminoethyl acrylate, quaternised N,N-dimethylaminoethyl methacrylate, 2-hydroxyethyl acrylate, 2-hydroxyethyl methacrylate, 2-hydroxyethyl ethacrylate, glyceryl acrylate, 2-methoxyethyl acrylate, 2-methoxyethyl methacrylate, 2-methoxyethyl ethacrylate, 2-ethoxyethyl acrylate, 2-ethoxyethyl methacrylate, 2-ethoxyethyl ethacrylate, maleic acid, maleic anhydride and its half esters, fumaric acid, itaconic acid, itaconic anhydride and its half esters, crotonic acid, angelic acid, diallyldimethyl ammonium chloride, vinyl pyrrolidone, vinyl imidazole, methyl vinyl ether, methyl vinyl ketone, maleimide, vinyl pyridine, vinyl pyridine-N-oxide, vinyl furan, styrene sulphonic acid and its salts, allyl alcohol, allyl citrate, allyl tartrate, vinyl acetate, vinyl alcohol, vinyl caprolactam, vinyl acetamide, vinyl formamide and mixtures thereof.

Even more preferred monomers are those selected from methyl acrylate, methyl methacrylate, methyl ethacrylate, ethyl acrylate, ethyl methacrylate, ethyl ethacrylate, n-butyl acrylate, t-butyl acrylate, n-butyl methacrylate, n-butyl ethacrylate, 2-ethylhexyl acrylate, 2-ethylhexyl methacrylate, 2-ethylhexyl ethacrylate, N-octyl acrylamide, 2-methoxyethyl acrylate, 2-hydroxyethyl acrylate, N,N-dimethylaminoethyl acrylate, N,N-dimethylaminoethyl methacrylate, glycerol methacrylate, acrylic acid, methacrylic acid, N-t-butylacrylamide, N-sec-butylacrylamide, N,N-dimethylacrylamide, N,N-dibutylacrylamide, N,N-dihydroxyethylacrylamide, 2-hydroxyethyl acrylate, 2-hydroxyethyl methacrylate, benzyl acrylate, 4-butoxycarbonylphenyl acrylate, butyl acrylate, 4-cyanobutyl acrylate, cyclohexyl acrylate, dodecyl acrylate, 2-ethylhexyl acrylate, heptyl acrylate, iso-butyl acrylate, 3-methoxybutyl acrylate, 3-methoxypropyl acrylate, methyl acrylate, N-butyl acrylamide, N,N-dibutyl acrylamide, ethyl acrylate, methoxyethyl acrylate, hydroxyethyl acrylate, diethyleneglycolethyl acrylate and mixtures thereof.

Particularly preferred for the flanking polymers are polymers or copolymers of styrene or an acrylamide eg, N,N-dialkylacrylamides, preferably N,N-dimethylacrylamide. Copolymers include, for example, random copolymers of an acrylamide with one or more other vinylic monomers eg, another acrylamide or an acrylate ester, as described hereinbefore. Representative examples of particularly preferred monomers for the flanking polymers therefore include, but are not restricted to: acrylamide, methacrylamide, N-tert-butylacrylamide, N-sec-butylacrylamide, N,N-dimethylacrylamide, N,N-dibutylacryiamide, N,N-dihydroxyethylacrylamide, acrylic and methacrylic acids and their sodium, potassium, ammonium salts, styrene, styrenesulphonic acid, N,N-dialkylaminoethyl acrylate, N,N-dialkylaminoethyl methacrylate, glycerol methacrylate, N,N-dialkylaminoethyl acrylamide, vinylformamide, tert-butyl acrylate, tert-butyl methacrylate, and, where the flanking polymer is a copolymer, mixtures thereof. N,N-dialkylacrylamides and N-alkylacrylamides, wherein the alkyl groups are $C_1$–$C_8$ straight or branched chain alkyl (particularly N,N-dimethylacrylamide), and styrenes are the most preferred class of monomers for the flanking polymer, and are preferably used as copolymers with C1–C6 alkyl acrylate or methacrylate esters (such as methyl methacrylate) or acrylic acid when one or both of the flanking polymers is a copolymer.

It is preferred that the core polymer is a polymer or copolymer of an acrylate ester. Copolymers may, for example, be random copolymers of two or more (preferably two) different acrylate esters. Preferred acrylate esters are esters of acrylic acid and $C_1$–$C_8$ straight or branched chain alcohols. Representative examples of monomers for the core polymer include, but are not restricted to: benzyl acrylate, 4-butoxycarbonylphenyl acrylate, butyl acrylate, 4-cyanobutyl acrylate, cyclohexyl acrylate, dodecyl acrylate, 2-ethylhexyl acrylate, heptyl acrylate, iso-butyl acrylate, 3-methoxybutyl acrylate, 3-methoxypropyl acrylate, methyl acrylate, neopentyl acrylate, nonyl acrylate, octyl acrylate, phenethyl acrylate, propyl acrylate, N-butyl acrylamide, N,N-dibutyl acrylamide, ethyl acrylate, methoxyethyl acrylate, hydroxyethyl acrylate, diethyleneglycolethyl acrylate. More preferred are polymers or copolymers of a (C1–C3 alkoxy)C1–C6 alkyl acrylate. Particularly preferred core polymers are polymers or copolymers of (2-methoxyethyl) acrylate. The copolymers may be copolymers of (2-methoxyethyl) acrylate with $C_1$ to $C_6$ alkyl acrylate esters such as, for example, t-butyl acrylate.

Other preferred core polymers include polymers or copolymers of ethene, propene, butene, $C_{2-4}$ alkylene glycols, especially poly(ethylene glycol), $C_{4-8}$ alkadienes, especially butadiene (cis- or trans-) and isoprene (cis- or trans-). If the core polymer is a polymer or a copolymer of butadiene or isoprene, the butadiene or isoprene residues may be fully or partially hydrogenated.

Alternatively, preferred core polymers may include polysiloxanes having nucleophilic end-groups which may be linear, branched or hyperbranched, provided they have at least one nucleophilic end-group as described above. Typically, such an end-group is one capable of nucleophilic attack via its O, N or S atom.

Examples of preferred polysiloxanes have the formula $$[Y(R^{12})_p—Si(R^{10})(R^{11})—O—[Si(R^{10})(R^{11})—O]_n Si(R^{10})(R^{11})—(R^{13})_q Z]$$

in which n is an integer from 5 to 1,000,000;

$R^{10}$ and $R^{11}$ are independently selected from monovalent, optionally substituted, linear or branched $C_{1-18}$ hydrocarbon radicals as described above;

$R^{12}$ and $R^{13}$ are independently selected from divalent, optionally substituted, linear or branched $C_{1-18}$ hydrocarbon radicals as described above;

p and q are integers having a value of 0 or 1, and

Y and Z are independently selected from hydroxyl, —$NH_2$ and —$NHR^{14}$ where $R^{14}$ is a monovalent, optionally substituted, linear or branched $C_{1-18}$ hydrocarbon radical as defined above, with the proviso that, either, but not both, of Y and Z may also be hydrogen or a monovalent, optionally substituted, linear or branched $C_{1-18}$ hydrocarbon radical as defined above, thereby giving a mono-end-capped polysiloxane.

Particularly preferred polysiloxanes corresponding to the above general formula have:

n=5 to 1,000,000, preferably 5 to 500;

$R^{10}$ and $R^{11}$=methyl, p and q=0 and Y and Z=hydroxyl; or p and q=1, $R^{12}$ and $R_{13}$=$(CH_2)_3$ and Y and Z =$NH_2$.

Polydimethylsiloxane is particularly preferred as a core polymer.

Preferably, the block copolymer of the invention contains up to 85% by weight of the flanking polymers, based on flanking and core polymers. More preferably, the block copolymer contains from 20% to 85% by weight of the flanking polymers.

The core polymer is preferably a polymer of butadiene, (2-methoxyethyl) acrylate or ethylene glycol, a random copolymer of ethene and butene, or is polydimethylsiloxane. (2-Methoxyethyl)acrylate polymers and butadiene polymers are especially preferred. Preferably, the flanking polymers are polymers of glycerol methacrylate, 2-dimethylaminoethyl methacrylate or, especially N,N-dimethyl acrylamide or styrene. More preferably, the copolymer is a poly(2-dimethylaminoethyl methacrylate)-poly(ethylene glycol)-poly (2-dimethylaminoethyl methacrylate) block copolymer, a poly(glycerol methacrylate)-poly((2-methoxyethyl) acrylate)-poly(glycerol methacrylate) block copolymer, a poly (2-dimethylaminoethyl methacrylate)-poly (dimethylsiloxane)-poly(2-dimethylaminoethyl methacrylate) block copolymer, a poly (N,N-dimethyl-acrlamide)-[ poly(2-methoxyethyl)acrylate)-poly(tert-butyl acrylate)]-poly(N,N-dimethyl acrylamide) block copolymer, a [poly(N,N-dimethyl acrylamide)-poly(methyl methacrylate)]-poly((2-methoxyethyl)acrylate)-[poly(N,N-dimethyl acrylamide)-poly(methyl methacrylate)] block copolymer, a poly(N,N-dimethyl acrylamide)-poly ((2-methoxyethyl) acrylate)-poly(N,N-dimethyl acrylamide) block copolymer, a poly(styrene)-poly (butadiene)-poly(styrene) block copolymer, a poly(styrene)-poly(ethene-ran-butene)-poly(styrene) block copolymer, a poly(styrene)-poly(isoprene)-poly(styrene) block copolymer, a poly(styrene)-poly(ethene/butadiene)-poly(styrene) block copolymer, a poly(styrene)-poly(ethene)-poly(styrene) block copolymer, a poly(styrene)-poly(ethene/propene)-poly(styrene) block copolymer, a poly(styrene)-poly (propene)-poly(styrene) block copolymer, a poly(styrene)-poly(butene)-poly(styrene) block copolymer or a block copolymer selected from polyurethanes, polyesters, polyamides and poly(propene/ethene/propene).

The block copolymers of the invention may have further polymer chains grafted onto the core polymer and/or one or more (or all) of the flanking polymers. Suitable polymer chains for grafting onto the block copolymers include, for example, silicones, and polymers derived from monomers such as acrylate and methacrylate esters (eg, esters of acrylic or methacrylic acid with $C_1$–$C_8$ straight or branched chain alcohols), styrene (optionally substituted with one or more $C_1$–$C_{12}$ straight or branched chain alkyl groups) and mixtures thereof. Other suitable polymer chains include polyalkyleneglycols, such as polyethyleneglycol or polypropyleneglycol. The polymer chains which may be grafted onto the block copolymers may be hydrophobic or hydrophilic or mixtures of hydrophobic and hydrophilic chains. Suitable hydrophobic and hydrophilic macromers for the grafts are described in WO 95/06078.

ABA Block Copolymers

The preferred polymers for use in the present invention are ABA block copolymers. As used herein, "A-B-A block copolymer" refers to a polymer comprising at least three segments having at least two differing compositions and also having any one of a number of different architectures, where the monomers are not incorporated into the polymer architecture in a solely statistical or uncontrolled manner. The transition from each A block to B block may be sharply defined or may be tapered (ie, there may be a gradual compositional change from A to B blocks). Although there may be two, three, four or more monomers in a single block-type polymer architecture, it will still be referred to herein as a block copolymer. In some embodiments, the block copolymers of this invention include one or more blocks of random copolymer (referred to herein as an "R" block) together with one or more blocks of single monomers. Thus, the polymer architecture may be A-R-A, R—B—R, R—B-A, R—R'—R, A-R—B-A or A-R—B—R-A, where R and R' are random blocks of monomers A and B or of monomers B and C or more monomers. Moreover, the random block can vary in composition or size with respect to the overall block copolymer. In some embodiments, for example, the random block will account for between 5 and 80% by weight of the mass of the block copolymer. In other embodiments, the random block R will account for more or less of the mass of the block copolymer, depending on the application. Furthermore, the random block may have a compositional gradient of one monomer to the other (e.g., A:B) that varies across the random block in an algorithmic fashion, with such algorithm being either linear having a desired slope, exponential having a desired exponent (such as a number from 0.1–5) or logarithmic. The random block may be subject to the same kinetic effects, such as composition drift, that would be present in any other radical copolymerization and its composition, and size may be affected by such kinetics, such as Markov kinetics. Any of the monomers listed elsewhere in this specification may be used in the block copolymers of this invention.

A "block" within the scope of the block copolymers of this invention typically comprises about 5 or more monomers of a single type (with the random blocks being defined by composition and/or weight percent, as described above). In preferred embodiments, the number of monomers within a single block may be about 10 or more, about 15 or more, about 20 or more or about 50 or more. Each block may have a desired architecture and thus, each block may be linear, branched (with short or long chain branches), star (with 3 or more arms), etc. Other architectures will be apparent to those of skill in the art upon review of this specification.

In one embodiment, block copolymers are assembled by the sequential addition of different monomers or monomer mixtures to living polymerization reactions. In another embodiment, the addition of a pre-assembled functionalized block (such as a telechelic oligomer or polymer) to a free radical polymerization mixture yields a block copolymer (e.g., the polymerization mixture may be controlled or "living"). Ideally, the growth of each block occurs with high conversion. Conversions are determined by NMR via integration of polymer to monomer signals. Conversions may also be determined by size exclusion chromatography (SEC) via integration of polymer to monomer peak. For UV detection, the polymer response factor must be determined for each polymer/monomer polymerization mixture. Typical conversions can be 50% to 100% for each block, more specifically in the range of from about 60% to about 90%). Intermediate conversion can lead to block copolymers with a random copolymer block separating the two or more homopolymer blocks, depending on the relative rates of polymerization and monomer addition. At high conversion, the size of this random block is sufficiently small such that it is less likely to affect polymer properties such as phase separation, thermal behaviour and mechanical modulus. This fact can be intentionally exploited to improve polymerization times for many applications without measurably affecting the performance characteristics of the resulting polymer. This is achieved by intentionally "killing" or terminating the living nature of the polymerization when a desired level of conversion (e.g., >80%) is reached by, e.g., cooling the polymerization to room temperature or by neutralizing the control agent, for example by introducing acids, bases, oxidizing agents, reducing agents, radical sources, scavengers, etc. In the absence of a radical control agent, the polymerization continues uncontrolled (typically at much higher reaction rates) until the remaining monomer is consumed.

When the block copolymer contains a polysiloxane, it may be formed in the presence of an atom transfer radical initiator via a nucleophilic displacement reaction between the nucleophilic end-groups on the polysiloxane and leaving groups on the other polymers respectively. The nucleophilic displacement reaction of the second reaction step may be carried out under conventional reaction conditions. This process is described in more detail in International publications nos. WO 00/71606 and WO 00/71607.

A typical polysiloxane block copolymer obtainable by the process described above is built up from units of the general formula [A]L[B], in which A is a polymeric block built up from radically polymerisable monomer, B is a polysiloxane block and L is a divalent linker group which links the A and B blocks via O—Si, N—Si or S—Si bonds to the B block. Preferably L is selected from:

—$R^{15}$—C(O)—O—;
—$R^{15}$—O—C(O)—O—;
—$R^{15}$—C(O)—N($R^{16}$)—;
—$R^{15}$—O—C(O)—N($R^{16}$)—, or
—$R^{15}$—N($R^{16}$)—C(O)—N($R^{17}$)—;

in which $R^{15}$ is a divalent, optionally substituted, linear or branched $C_{1-18}$ hydrocarbon radical as described above, and $R^{16}$ and $R^{17}$ are independently selected from monovalent, optionally substituted, linear or branched $C_{1-18}$ hydrocarbon radicals as described above.

The overall molecular architecture of the silicone block copolymers of the invention can be described by the formulas A-L-B, A-L-B-L-A, -(A-L-B)$_n$—, wherein n is an integer of 2 or greater, or [A-L-][A-L-]B[-L-A][-L-A], wherein A-L-B represents a diblock structure, A-L-B-L-A represents a triblock structure, -(A-L-B)$_n$— represents a multiblock structure, and [A-L-][A-L-]B[-L-A][-L-A] represents a dendritic structure.

The existence of a block copolymer according to this invention is determined by methods known to those of skill in the art. For example, those of skill in the art may consider nuclear magnetic resonance (NMR) studies of the block copolymer. Those of skill in the art would also consider the measured increase of molecular weight upon addition of a second monomer to chain-extend a living polymerization of a first monomer. Block copolymer structure can be suggested by observation microphase separation, including long range order (determined by X-ray diffraction), microscopy and/or birefringence measurements. Other methods of determining the presence of a block copolymer include mechanical property measurements, (e.g., elasticity of soft/hard/soft block copolymers), thermal analysis and chromatography (e.g., absence of homopolymer).

Measurement of optical properties, such as absorbance (color and clarity), provides information about the phase morphology and microstructure of the polymer emulsions. Thus, for example, birefringence measurements may indicate the presence of optical anisotropy resulting from microphase separation in hard/soft block copolymers.

Likewise, sharp color delineations in optical micrographs of annealed polymer films can indicate the presence of ordered, microphase-separated block copolymer structure.

Block copolymers of sufficiently high molecular weight phase separate on a microscopic scale, to form periodically arranged microdomains which typically comprise predominantly one or the other polymer. These may take the form of lamellae, cylinders, spheres, and other more complex morphologies, and the domain sizes and periods are typically in the range 10–100 nm. Such microphase separation can be detected obtained in a variety of ways, including electron microscopy, x-ray or neutron scattering or reflectivity, measurement of optical anisotropy, and rheological measurements. The absence of a periodic microstructure is not necessarily evidence against having synthesized a block copolymer, as such absence may be due to low molecular weight, broad molecular weight distribution of the individual blocks, weak intermolecular interactions, or inadequate time and slow kinetics for microphase separation. However, the presence of a periodic microstructure on the 10–100 nm scale is considered extremely compelling evidence for block copolymer formation in accord with this invention. A periodic microstructure is not, however, an essential feature of the copolymers which may be used in the compositions of this invention.

Block copolymers are well-known to form terraced films, where the film thickness is restricted to integer or half-integer multiples of the microstructure period. This occurs because preferential interactions of one or the other block with the substrate and/or free surface cause a layering of the microdomains parallel to the film surface (see for example G. Coulon, D. Ausserre, and T. P. Russell, *J. Phys.* (Paris) 51, 777 (1990); and T. P. Russell, G. Coulon, V. R. Deline, and D. C. Miller, *Macromolecules* 22, 4600–6 (1989)). When observed in a reflection microscope (on a reflecting substrate such as a silicon wafer), the terracing manifests itself as a series of discrete, well-defined colors with sharp boundaries between them. The colors are a result of interference between light reflected from the top and bottom surfaces of the film, and depend on the local film thickness ("Newton's rings"). If terracing does not occur, the colors blend continuously from one into the other.

The presence of chemically homogeneous sequences within block copolymers leads to a phase transition known as microphase separation. Energetically unfavorable interactions between chemically distinct monomers drive the blocks to separate into spatially distinct domains. Since the blocks are covalently bound together, these domains are comparable in size to the dimensions of the polymers themselves. The presence of these domains alters the physical properties of the materials, giving the resulting composite many of the chemical and physical characteristics of each block.

Polymerisation Process

The block copolymers utilised in the present invention may be prepared by any of a number of conventional methods know to the person skilled in the art. For instance, living free radical polymerisation methods can be used. Such polymerisations are described in the literature, for example: Tailored polymers by free radical processes, E Rizzardo et al, Macromol. Symp. 1999, 143 (World Polymer Congress, 37$^{th}$ International Symposium on Macromolecules, 1998), 291–307, ISSN: 102–1360: also Atom transfer radical polymerisation and controlled radical polymerisation, Z Zhang, et al, Gaofenzi Tongabo, 1999, (3) 138–144; K Matyjazewski, Classification and comparison of various controlled/ "living" radical polymerisations, Book of Abstracts, 218$^{th}$ ACS National Meeting, New Orleans, Aug. 22–26 (1999), Poly-042.

In principle, any "living" free radical polymerisation techniques such as nitroxide radical controlled, atom transfer radical polymerisation (ATRP), reversible addition fragmentation chain transfer (RAFT) and catalytic chain transfer (CCT) could be used. Some of the preferred polymerisation routes for the block copolymers used in this invention are nitroxide mediated processes. Thus, a bis-nitroxide initiator may be employed to produce well-defined ABA block copolymers. The process comprises two steps. In the first step, a core polymer of a defined length is synthesised with the bis-nitroxide initiator at the "centre" of the core polymer. This involves the living polymerisation of the monomer or monomers with a bis-nitroxide initiator. After this first stage is complete, the core polymer is optionally purified or used without purification. The second step involves the introduction of the flanking polymer monomer or monomers using the same technique of living polymerisation. The polymerisation process can be closely monitored by gel permeation chromatography (GPC), NMR and viscosity measurements. The polymerisation process is preferably stopped when high conversions are achieved.

Other preferred polymerisation routes for the block copolymers used in this invention involve the preparation of a macroinitiator of the core polymer and the subsequent formation of the desired block copolymer in an atom transfer radical polymerisation reaction.

Living free radical polymerisation techniques suitable for use in the preparation of polymers for use in the invention include, for example, those described in Hawker et al., "Development of a Universal Alkoxyamine for 'Living' Free Radical Polymerizations," *J. Am. Chem. Soc.*, 1999, 121 (16), pp. 3904–3920 for a nitroxide mediated processes and in U.S. patent application Ser. No. 09/520,583, filed Mar. 8, 2000 and corresponding international application PCT/US00/06176, which process is particularly preferred, and both of these applications are incorporated herein by reference.

Suitable polymerisation reactions include, for example, the following ratios of starting materials, temperature, pressure, atmosphere and reaction time. Temperatures for polymerization are typically in the range of from about 0° C. to about 130° C., more preferably in the range of from about 20° C. to about 130° C. and even more preferably in the range of from about 25° C. to about 130° C. The atmosphere may be controlled, with an inert atmosphere being preferred, such as nitrogen or argon. The molecular weight of the polymer can be controlled via controlled free radical polymerization techniques or by controlling the ratio of monomer to initiator. Generally, the ratio of monomer to initiator is in the range of from about 200 to about 800. In a nitroxide radical controlled polymerization the ratio of control agent to initiator can be in the range of from about 1 mol % to about 10 mol % and this is preferred. The polymerization may be carried out in bulk or in a suitable solvent such as diglyme. Polymerization reaction time may be in the range of from about 0.5 hours to about 72 hours, preferably from about 1 hour to about 24 hours and more preferably from about 2 hours to about 12 hours.

Compositions of the Invention

Compositions of the present invention are preferably formulated into fabric care compositions comprising a solution, dispersion or emulsion comprising a polycarboxylic acid or a derivative thereof, a catalyst and a thermoplastic elastomer, such compositions are preferably used in part of a laundering process. The laundering process may be a large scale or small-scale (e.g. domestic) process. When the laundering process is a domestic process, the composition may be packaged and labelled for this use.

The polymer composition comprises a polycarboxylic acid or a derivative thereof, a catalyst and a thermoplastic elastomer as described above. The composition may contain other components, for example other polymers which impart benefits to a fabric.

In an industrial treatment process, the concentration of polycarboxylic acid used in the treating solution may be in the range of 0.01% to 20% by weight depending on the solubility of the polycarboxylic acid and the degree of cellulose crosslinking required as determined by the level of wrinkle resistance, smooth drying properties and shrinkage resistance desired. It is desirable if the level of carboxylic acid or derivatives thereof is from 0.1% to 20% of the total composition, preferably from 1% to 20%.

If the composition is to be used in a laundry process as part of a conventional fabric treatment product, such as a rinse conditioner or main wash product, it is preferable if the level of polycarboxylic acid or derivative thereof is from 0.01% to 10%, preferably 0.05% to 5%, most preferably 0.1 to 3 wt % of the total composition.

If however the composition is to be used in a laundry process as a product to specifically treat the fabric to reduce creasing, higher levels of polycarboxylic acid or derivative thereof should be used preferably in amounts of from 0.01% to 15%, more preferably 0.05% to 10%, for example from 0.1 to 5 wt % of the total composition.

If the composition is to be used in a spray product it is preferred if the level of polycarboxylic acid or derivative thereof is from 0.5 to 20 wt %, preferably 1 to 10 wt % of the total composition.

It is preferred that the catalyst is used in a molar ratio of from 5:1 to 1:5, preferably 3:1 to 1:3, catalyst to polycarboxylic acid. More preferably, if the polycarboxylic acid has n carboxyl groups, n-1 moles of catalyst are used per mole of polycarboxylic acid.

In the present invention, the composition comprises from 0.01% to 15% by weight of the thermoplastic elastomer.

Advantageously, in an industrial treatment process, the concentration of thermoplastic elastomer used in the treating solution may be in the range from 0.01% to 15% preferably 0.1% to 15%, more preferably 1% to 15%.

If the composition is to be used in a laundry process as part of a conventional fabric treatment product, such as a rinse conditioner or a main wash product, it is preferable that the level of thermoplastic elastomer is from 0.01% to 7.5%, preferably 0.05% to 3.75%, more preferably from 0.1 to 2.25%, by weight of the total composition.

If however the composition is to be used in a laundry process as a product to specifically treat the fabric to reduce creasing, higher levels of polycarboxylic acid or derivative thereof should be used preferably in amounts of from 0.01% to 11.25%, more preferably 0.05% to 7.5%, for example from 0.1 to 3.75 wt % of the total composition.

If the composition is to be used in a spray product, it is preferred that the level of thermoplastic elastomer is from 0.5 to 15%, preferably 1% to 7.5%, by weight of the total composition.

Generally, the thermoplastic elastomer will at least partially coat individual fibres. At these levels of application, the physical properties of the fabric which make it suitable for use in a garment are retained (ie, the overall feel and appearance of the fabric remains substantially unchanged) but, unexpectedly, the fabric has improved crease recovery properties.

The crease recovery properties of a fabric treated according to the present invention are improved relative to fabric not so treated. Treatment of the fabric typically reduces the tendency of the fabric to remain creased. Thus, following treatment according to the invention, the crease recovery angle, which is a measure of the degree to which a fabric returns to its original shape following creasing, increases. The fabric may still require a degree of treatment (eg, by ironing) to reduce its creasing after washing and drying in a conventional domestic laundering process. However, the amount of crease reduction by ironing required for fabric treated according to the invention will typically be less than that required by untreated fabric. It will be appreciated that any reduction in the amount of crease reduction, such as ironing, which is required, is beneficial.

The method of the invention preferably comprises the step of applying a composition of the polycarboxylic acid or derivative thereof, the catalyst and the thermoplastic elastomer to a fabric and curing the composition, preferably by ironing. The composition may be applied to the fabric by conventional methods such as dipping, spraying or soaking, for example.

The fabric care composition of the invention preferably comprises a solution, dispersion or emulsion comprising a polycarboxylic acid and derivative thereof, a catalyst and thermoplastic elastomer and a textile compatible carrier. The textile compatible carrier facilitates contact between the fabric and the ingredients of the composition. The textile compatible carrier may be water or a surfactant. However, when it is water, it is preferred that a perfume is present. In a composition that is used during the washing or rinse cycles of a washing machine, it is highly preferable if the textile compatible carrier is a cationic surfactant, more preferably a cationic softening agent.

If the fabric care composition of the invention is in the form of a dispersion or emulsion or if, in the method of the invention, a dispersion or emulsion is used, the fabric treated with the composition may need to be heated to a temperature above the Tg of the hard blocks of the elastomer in order to obtain the advantages of the invention. The heating of the treated fabric can be carried out as a separate heating step or may form part of the laundering process eg taking place during drying of the fabric (for example in a tumble dryer) or, more preferably, during ironing of the fabric. Alternatively, a plasticiser or coalescing agent may be used to lower the Tg of the thermoplastic elastomer in order to avoid the need for heating or to reduce the temperature of the heating step required to obtain the advantages of the invention. In addition, the heating/curing step is required to crosslink the fabric with the polycarboxylic acid.

The method of the invention may be carried out as a treatment of the fabric before or after it has been made into garments, as part of an industrial textile treatment process. Alternatively, it may be provided as a spray composition eg, for domestic (or industrial) application to fabric in a treatment separate from a conventional domestic laundering process.

Alternatively, in the method of the invention, the treatment is carried out as part of a laundering process. Suitable laundering processes include large scale and small-scale (eg domestic) processes. Such a process may involve the use of a fabric care composition of the invention, for example. The fabric care composition of the invention may be a main wash detergent composition, in which case the textile compatible carrier may be a detergent and the composition may contain other additives, which are conventional in main wash detergent compositions. Alternatively, the fabric care composition may be adapted for use in the rinse cycle of a domestic laundering process, such as a fabric conditioning composition or an adjunct, and the textile compatible carrier may be a fabric conditioning compound (such as a quaternary alkylammonium compound) or simply water, and conventional additives such as perfume may be present in the composition.

In one particularly preferred embodiment, the composition may be provided in a form suitable for spraying onto a fabric. The fabric may then be dried, e.g. in a tumble dryer, and then ironed to cure the composition.

If this is the case, it is preferred if the polycarboxylic acid or derivative thereof is present at a level from 0.5 to 20 wt %, preferably 0.5 to 10 wt %, of the total composition. If the product is to be used in a spray on product it is also beneficial if wetting agents are also present such as alcohol ethoylates for example, Syperonic A7.

For a spray on formulation anionic surfactants may be present.

Suitable spray dispensing devices are disclosed in WO 96/15310 (Procter & Gamble) and are incorporated herein by reference.

Spray products may contain water as a carrier molecule. In some cases to reduce wrinkling of the fabric it is beneficial for spray products to further comprise ethanol, isopropanol or glycol.

It is advantageous in compositions for use in a domestic setting to further comprise a plasticiser. In the context of this invention, a plasticiser is any material that can modify the flow properties of the thermoplastic elastomer. Suitable plasticisers include $C_{12}$–$C_{20}$ alcohols, glycol ethers, phthalates and automatic hydrocarbons. It is also highly advantageous, if the compositions comprise a perfume.

It is particularly advantageous, and surprising, that the composition can be cured by ironing, even under domestic conditions. Moreover, a steam iron can be used, which is desirable to aid wrinkle removal, with no deleterious effects on the curing process.

A further advantage of the method of the invention is that, when the composition is applied as a spray, one application is sufficient to obtain wrinkle and shape retention benefits for many subsequent washes. Also, application will result in easier ironing of garments.

If the composition is applied during the wash or rinse cycle of a laundry process, a progressive build-up of benefits is observed after each wash, although curing with an iron is required after each wash. Thus, garments become progressively less wrinkled and progressively easier to iron over successive applications.

Detergent Active Compounds

If the fabric care composition of the present invention is in the form of a detergent composition, the textile compatible carrier may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred textile compatible carriers that can be used are soaps and synthetic non-soap anionic and nonionic compounds.

Anionic surfactants are well known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+X^-$ wherein the R groups are independently hydrocarbyl chains of $C_1$–$C_{22}$ length, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters) and pyridinium salts.

The total quantity of detergent surfactant in the composition is suitably from 0.1 to 60 wt % e.g. 0.5–55 wt %, such as 5–50 wt %.

Preferably, the quantity of anionic surfactant (when present) is in the range of from 1 to 50% by weight of the total composition. More preferably, the quantity of anionic surfactant is in the range of from 3 to 35% by weight, e.g. 5 to 30% by weight.

Preferably, the quantity of nonionic surfactant when present is in the range of from 2 to 25% by weight, more preferably from 5 to 20% by weight.

Amphoteric surfactants may also be used, for example amine oxides or betaines.

The compositions may suitably contain from 10 to 70%, preferably from 15 to 70% by weight, of detergency builder. Preferably, the quantity of builder is in the range of from 15 to 50% by weight.

The detergent composition may contain as builder a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{–}1.5\ M_2O.\ Al_2O_3.\ 0.8\text{–}6\ SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature.

Fabric Softening and/or Conditioner Compounds

If the fabric care composition of the present invention is in the form of a fabric conditioner composition, the textile compatible carrier will be a fabric softening and/or conditioning compound (hereinafter referred to as "fabric softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the fabric in the tumble dryer if used in a suitable form. Thus, another product form is a composition (for example, a paste) suitable for coating onto, and delivery from, a substrate e.g. a flexible sheet or sponge or a suitable dispenser during a tumble dryer cycle.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric-softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12\text{-}22}$ alkyl or alkenyl groups connected to the molecule via at least one ester link, preferably two ester links. An especially preferred ester-linked quaternary ammonium material can be represented by the formula II:

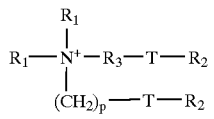

(II)

wherein each $R_1$ group is independently selected from $C_{1\text{-}4}$ alkyl or hydroxyalkyl groups or $C_{2\text{-}4}$ alkenyl groups; each $R_2$ group is independently selected from $C_{8\text{-}28}$ alkyl or alkenyl groups; and wherein $R_3$ is a linear or branched alkylene group of 1 to 5 carbon atoms, T is

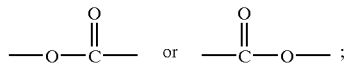

and p is 0 or is an integer from 1 to 5.

Di(tallowoxyloxyethyl) dimethyl ammonium chloride and/or its hardened tallow analogue is especially preferred of the compounds of formula (II).

A second preferred type of quaternary ammonium material can be represented by the formula (III):

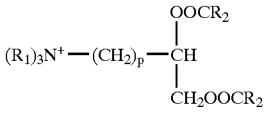

(III)

wherein $R_1$, p and $R_2$ are as defined above.

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example, $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions may include silicones, such as predominately linear polydialkylsiloxanes, e.g. polydimethylsiloxanes or aminosilicones containing amine-functionalised side chains; soil release polymers such as block copolymers of polyethylene oxide and terephthalate; amphoteric surfactants; smectite type inorganic clays; zwitterionic quaternary ammonium compounds; and nonionic surfactants.

The fabric conditioning compositions may also include an agent, which produces a pearlescent appearance, e.g. an organic pearlising compound such as ethylene glycol distearate, or inorganic pearlising pigments such as microfine mica or titanium dioxide ($TiO_2$) coated mica.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients include non-aqueous solvents, perfume carriers, fluorescers, colourants, hydrotropes, antifoaming agents, antiredeposition agents, enzymes, optical brightening agents, opacifiers, dye transfer inhibitors, anti-shrinking agents, anti-wrinkle agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents and ironing aids. This list is not intended to be exhaustive.

Fabric Treatment Products

The fabric care composition of the invention may be in the form of a liquid, solid (e.g. powder or tablet), a gel or paste, spray, stick or a foam or mousse. Examples including a soaking product, a rinse treatment (e.g. conditioner or finisher) or a mainwash product. The composition may also be applied to a substrate e.g. a flexible sheet or used in a dispenser which can be used in the wash cycle, rinse cycle or during the dryer cycle.

The present invention has the advantage not only of increasing the crease recovery angle of fabric but also of improving the elasticity, shape retention and tensile strength (especially the tear strength) of the fabric. Surprisingly, these beneficial effects are durable, that is, they are sustained through a number of subsequent washes without reapplication of the composition of the invention.

The following non-limiting examples illustrate the invention.

EXAMPLES

Nomenclature:

BTCA: Butane 1,2,3,4-tetracarboxylic acid ex. Aldrich $NaH_2PO_2$: Sodium hypophoshpite hydrate ex. Aldrich PSBS: Polystyrene-block-polybutadiene-block-polystyrene ex. Aldrich (prepared into 5% aqueous dispersion in house)

Example 1

Increasing Level of Sodium Hypophosphite Catalyst Reduces the Iron Cure Time

Protocol:

The following solutions were prepared and pad applied to oxford cotton fabric (18×6 cm) at 100% pick-up. The fabric swatches were then tumble dried, followed by an iron cure on high setting (cotton/linen) for the time specified.

Control: 50 g water 2% BTCA (1 g)+1 mole (0.76%) $NaH_2PO_2$ (0.38 g)+water to 50 g 2% BTCA (1 g)+3 mole (2.28%) $NaH_2PO_2$ (1.18 g)+water to 50 g The fabric swatches were ironed for −2 s (light iron to flatten), 10 s and 20 s, conditioned at 20° C., 65% relative humidity then the crease recovery angle (CRA) measured (using a modified method based on BS1553086). A sample of fabric (25 mmx50 mm) is folded in half forming a sharp crease and held under a weight of 1 kg for 1 minute. On releasing the sample the crease opens up to a certain degree. After 1 minute relaxation time the angle is measured. The fabric is tested in the warp direction only (hence maximum CRA is 180°). Higher CRAs correspond to less wrinkled fabrics.

Results:

| Iron time | Control (CRA) | 2% BTCA + 0.76% $NaH_2PO_2$ (CRA) | 2% BTCA + 2.28% $NaH_2PO_2$ (CRA) |
|---|---|---|---|
| Light iron | 73 | 74 | 89 |
| 10 s | — | 93 | 107 |
| 20 s | 74 | 100 | 116 |

Example 2

Combination of BTCA and Thermoplastic Elastomer (PSBS) Increases CRA for Short Iron Times Protocol:

The following solutions were prepared and pad applied to oxford cotton fabric (40×40 cm) at 100% pick-up. The fabric swatches were then tumble dried, followed by an iron cure on high setting (cotton/linen) for the time specified.

Control: 300 g water 2% BTCA (6 g)+2.28% $NaH_2PO_2$ (6.76 g)+water to 300 g 2% BTCA (6 g)+2.28% $NaH_2PO_2$ (6.76 g)+1.5% poly(styrene-butadiene-styrene) (90 g of 5% dispersion)+water to 300 g The fabrics were ironed on a high setting for 20 s, 60 s and 120 s then again the CRA measured. Note—the iron time was higher than previous due to larger pieces of cotton being used (40×40 cm vs. 18×6 cm)

Results:

| Iron time | Control | BTCA | BTCA + PSBS |
|---|---|---|---|
| 20 s | 74 | 78 | 92 |
| 60 s | 74 | 97 | 109 |
| 120 s | 77 | 108 | 106 |

Example 3

Combination of BTCA and Thermoplastic Elastomer Eliminates Tear Strength Negative of Durable Press Finishes Protocol:

The materials were applied as described in Example 2 above. Wing rip tear measurements were made based on BS 4303:1968. The fabric is cut into the pre-determined shape using a template, with the long edge running parallel to the warp direction. A cut is made down the centre of the fabric, and a point 25 mm from the end of the cut is marked clearly on the fabric. The fabric is then mounted on the tensile tester and ripped until the tear reaches the 25 mm mark on the fabric. The mean tearing force is then calculated.

Results:

The table below shows that when the BTCA is applied on its own, the tear resistance of the fabric decreases with increasing cure time (compared to the untreated control). However, when the thermoplastic elastomer is applied, it returns the fabric strength to the same level as the untreated control—i.e. no loss in strength

| Iron time | Control (tear resistance kgf) | BTCA (tear resistance kgf) | BTCA + PSBS (tear resistance kgf) |
|---|---|---|---|
| 20 s | 1.49 | 1.30 | 1.66 |
| 60 s | 1.53 | 1.21 | 1.60 |
| 120 s | 1.53 | 1.02 | 1.55 |

Example 4

Durable Effect of the Wrinkle Benefit After Multi-washes

Protocol:

The following solutions were prepared and pad applied to oxford cotton fabric (40×40 cm) at 100% pick-up. The monitors were then tumble dried followed by a 60 s cure using an iron on a high heat setting. 2% BTCA (20 g)+2.28% $NaH_2PO_2$ (22.8 g) water to 1000 g 2% BTCA (20 g)+2.28% $NaH_2PO_2$ (22.8 g)+1.5% PSBS (300 g of 5% dispersion) +water to 1000 g The treatments were subjected to 5 washes, with the level of wrinkling assessed after each wash. In addition, two controls of detergent only and detergent+fabric conditioner (standard dose of 35 ml in rinse) were included. For each treatment, the monitors were added to cotton ballast to make a total load weight of 2.5 kg. This load was washed with 90 g detergent powder in a front loading European washing machine using a 40° C. cotton programme. Each load was then tumble dried, followed by assessment of the level of wrinkling of the monitors against an internal wrinkle scale. (Scale between 0 and 9 where 0=no wrinkles and 9=highly wrinkled)

Results:

| Wash No. | Untreated control (crease rating) | Fabric Conditioner Control (crease rating) | BTCA (crease rating) | BTCA + PSBS (crease rating) |
|---|---|---|---|---|
| 1 | 8.4 | 7.9 | 5.2 | 4.1 |
| 2 | 8.0 | 7.6 | 4.9 | 5.1 |
| 3 | 8.6 | 7.4 | 5.7 | 5.1 |
| 4 | 8.5 | 7.4 | 5.7 | 5.2 |
| 5 | 8.4 | 7.5 | 5.9 | 5.0 |

Tear strength benefit still obtained after 5 washes:

| Wash no. | Untreated control - tear resistance (kgf) | BTCA - tear resistance (kgf) | BTCA + PSBS - tear resistance (kgf) |
|---|---|---|---|
| 1 | 1.50 | 1.01 | 1.36 |
| 5 | 1.40 | 1.01 | 1.36 |

Example 5

BTCA+PSBS from a Spray—Wrinkle Benefit

Protocol:

A spray prototype was prepared as follows: BTCA (5.72 g)+$NaH_2PO_2$ (6.45 g)+PSBS (85.8 g of a 5% dispersion) +water to 100 g. The mixture was placed in a triggered spray bottle and sprayed onto 40×40 cm oxford and poplin cotton monitors to give an increase in weight of 35% (corresponding to 2% BTCA on fabric etc). The monitors were then dried followed by a 1 minute iron cure on a high iron setting. The monitors (and ballast) were then subjected to a full wash using a standard dose of detergent powder. A control wash with detergent and fabric conditioner (dosed in the rinse) was also carried out (i.e. monitors were not sprayed with prototype). The washed loads were then tumble dried followed by wrinkle assessment against an internal wrinkle scale (0=no wrinkles, 9=highly wrinkled).

| | Results: | |
|---|---|---|
| Fabric type | Fabric. Conditioner Control (crease rating) | Prototype (crease rating) |
| Oxford cotton | 7.35 | 2.9 |
| Poplin cotton | 8.3 | 4.5 |

Example 6

Shape Retention Benefits from BTCA and Thermoplastic Elastomer

The thermoplastic elastomer PSBS dispersion was applied to prewashed woven sheeting (40×40 cm) and poplin (40×40 cm) by pad application at a level of 1.5% on weight of fabric. BTCA was applied at 2% with 3 mole equivalents of Sodium hypophosphite catalyst. The dried sheets were iron cured for 1 minute and then conditioned at 65% relative humidity and 20° C. for at least 24 hrs The fabric extension parameters defined below were measured using a Testometric tester when a sample is stretched and relaxed.

Sample size: 150 mm×50 mm cut on the bias

Area of stretching: 100 mm×25 mm

Elongation Rate: 100 mm/min

Measurement: Extend the fabric by 20 mm and return to 0 mm measuring the force

Ability to Recover from Deformation (ARfD) is related to the force exerted by the fabric during recovery and is defined as the force exerted after recovering by 10 mm (RF10) normalised to that for untreated fabric ($RF10_0$).

$$ARfD = \frac{RF10}{RF10_o}$$

Values greater than 1 show increased ability to recover from deformation compared to untreated fabric, and hence provide better shape retention. The example listed in Table 1 all has an ArfD value greater than 1 and greater than BTCA or PSBS alone

TABLE 1

| | ArfD | |
|---|---|---|
| Name | Sheeting | Poplin |
| 1.5% PSBS 2% BTCA | 10.5 | 2.64 |
| 1.5% PSBS | 7.52 | 2.12 |
| 2% BTCA | 3.76 | 0.92 |

The Residual Extension (RE) is defined as the extension during the recovery cycle at which the measured force drops below 0.006 kgf. The examples listed in Table 2 showed a reduced residual extension (RE) relative to untreated fabric with the reduction for the combined treatment being the greatest, again indicating better shape retention.

TABLE 2

| | RE | |
|---|---|---|
| Name | Sheeting | Poplin |
| Untreated | 10.20 | 7.99 |
| 1.5% PSBS 2% BTCA | 5.94 | 5.23 |
| 1.5% PSBS | 6.48 | 5.51 |
| 2% BTCA | 8.63 | 7.97 |

The resistance of a fabric to deformation is also important in stretch and bagging prevention. This can be measured by three parameters Force at 10 mm (F10E) extension—the greater the force the greater the resistance to deformation Modulus (MOD)—the gradient of the extension curve=stress/strain and is related to fabric stiffness, the greater the modulus the greater the resistance to deformation Force at 20 mm (F20E) extension—the greater the force the greater the resistance to deformation The mixture of PSBS and BTCA shows values greater than control for all these parameters Table 3 (sheeting) and Table 4 (Poplin)

TABLE 3

| Name | F10E | MOD | F20E |
|---|---|---|---|
| Untreated | 0.25 | 0.045 | 0.90 |
| 1.5% PSBS 2% BTCA | 0.34 | 0.051 | 1.03 |
| 1.5% PSBS | 0.23 | 0.034 | 0.69 |
| 2% BTCA | 0.23 | 0.047 | 0.95 |

TABLE 4

| Name | F10E | MOD | F20E |
|---|---|---|---|
| Untreated | 0.39 | 0.069 | 1.38 |
| 1.5% PSBS 2% BTCA | 0.48 | 0.070 | 1.41 |
| 1.5% PSBS | 0.40 | 0.062 | 1.26 |
| 2% BTCA | 0.36 | 0.071 | 1.44 |

Example 7

BTCA+PSBS from a Spray—Effect of Ironing Conditions

Protocol:

A spray prototype was prepared as follows: BTCA (5.72 g)+$NaH_2PO_2$ (6.45 g)+PSBS (85.8 g of a 5% dispersion) +water to 100 g. The mixture was placed in a triggered spray bottle and sprayed onto 40×40 cm oxford cotton monitors to give an increase in weight of 35% (corresponding to 2% BTCA on fabric etc). The monitors were then either tumble dried then ironed on high setting with or without steam, or were ironed while still wet (with steam). The clothes were then conditioned for 24 hours at 20° C., 65% r.h. then the crease recovery angle measured.

| Treatment | Ironed dry with no steam | Ironed dry with steam | Ironed wet with steam |
|---|---|---|---|
| Control | 74 | 76 | 73 |
| BTCA/PSBS | 108 | 106 | 95 |

Surprisingly, ironing with steam gives a comparable CRA to the cloth ironed with no steam. Obviously a consumer prefers to iron with steam, as it facilitates the removal of stubborn wrinkles and generally makes ironing easier. Ironing the cloth while still damp resulted in a drop in CRA.

Example 8

Build up of Wrinkle Benefit for BTCA and Citric Acid

The following solutions were pad applied to oxford cotton monitors (40×40 cm) at 100% pick-up. The monitors were then tumble dried and iron cured for 1 minute on a high setting with steam.

Solution (2000 $cm^3$):

a) 0.2% BTCA (4 g), 0.15% PSBS (60 g of 5% dispersion) and $NaH_2PO_2$ (4.5 g)

b) 0.2% Citric acid (4 g), 0.15% PSBS (60 g of 5% dispersion) and $NaH_2PO_2$ (3.66 g)

Cotton sheeting ballast was added to each set of monitors to give a total load weight of 1.5 kg. In addition, an untreated control was also included. Each treatment (and control) was then subjected to a 40° C. wash with detergent powder (100 g). The load was then tumble dried, and the monitors panelled against an in-house wrinkle scale. The pad/wash/panel cycle was then repeated a further nine times, such that after the $10^{th}$ pad/wash, the maximum level of BTCA or citric acid on the fabric was 2% (and 1.5% PSBS).

| Wash no. | Wrinkle score for control | Wrinkle score for BTCA/PSBS | Wrinkle score for Citric acid/PSBS |
|---|---|---|---|
| 1 | 7.24 | 6.53 | 6.17 |
| 2 | 8.11 | 5.59 | 5.75 |
| 3 | 7.67 | 4.62 | 4.57 |
| 4 | 7.61 | 4.80 | 4.41 |
| 5 | 7.84 | 4.25 | 4.79 |
| 6 | 7.68 | 3.75 | 3.97 |
| 7 | 7.72 | 3.30 | 3.39 |
| 8 | 7.39 | 3.42 | 3.38 |
| 9 | 6.55 | 3.20 | 3.07 |
| 10 | 7.50 | 3.15 | 2.93 |

Internal wrinkle scale:
0 = flat,
10 = highly wrinkled

Data shows that both BTCA/PSBS and citric acid/PSBS progressively reduce the level of the number of applications increase.

The invention claimed is:

1. A fabric care composition comprising a polycarboxylic acid or a derivative thereof, a catalyst and a thermoplastic elastomer in which the thermoplastic elastomer is a block copolymer comprising a core polymer and two or more flanking polymers, each flanking polymer being covalently bound to an end of the core polymer.

2. A composition according to claim 1, in which the polycarboxylic acid or derivative thereof contains at least 3 carboxyl groups.

3. A composition according to claim 1, in which the polycarboxylic acid or derivative thereof is 1 ,2,3,4-butanetetracarboxylic acid or citric acid.

4. A composition according to claim 1, in which the catalyst is an alkali metal hypophosphite, an alkali metal phosphite, an alkali metal polyphosphate or an alkali metal dihydrogen phosphate.

5. A composition according to claim 1, in which the catalyst is sodium hypophosphite.

6. A composition according to claim 1, in which the core polymer has a Tg of from −150° C. to 50° C.

7. A composition according to claim 1, in which the flanking polymers have a Tg of from 30° C. to 150° C.

8. A composition according to claim 1, in which the block copolymer is linear or star-shaped.

9. A composition according to claim 1, in which the block copolymer is a linear ABA block copolymer.

10. A composition according to claim 1, in which the core polymer is a polymer of an ethylenically unsaturated monomer.

11. A composition according to claim 1, in which the core polymer is a polymer of butadiene or a random copolymer of ethene and butene.

12. A composition according to claim 1, in which the flanking polymers are polymers of an ethylenically unsaturated monomer.

13. A composition according to claim 1, in which the flanking polymers are polymers of styrene.

14. A composition according to claim 1, in which the polycarboxylic acid or derivative thereof is present in an amount of from 0.01% to 20% by weight of the total composition.

15. A composition according to claim 1, in which the catalyst is present in a mole ratio of from 5:1 to 1:5 catalyst to polycarboxylic acid.

16. A composition according to claim 1, in which the thermoplastic elastomer is present in an amount of from 0.01% to 15% by weight of the total composition.

17. A composition as claimed in claim 1, which is in a form suitable for spraying onto a fabric.

18. A method of treating fabric which comprises treating the fabric with a fabric care composition according to claim 1 and curing the composition.

19. A method according to claim 18, in which the composition is applied to the fabric prior to drying and/or ironing.

20. A method according to claim 18, in which the composition is cured by ironing.

21. A method for increasing the tensile strength of a fabric comprising the step of treating a fabric with the composition of claim 1.

22. A method for reducing the creasing and/or wrinkling of a fabric comprising the step of treating a fabric with the composition of claim 1.

23. A method for improving the elasticity and/or shape retention of a fabric comprising the step of treating a fabric with the composition of claim 1.

* * * * *